US005822440A

United States Patent [19]

Oltman et al.

[11] Patent Number: 5,822,440

[45] **Date of Patent: *Oct. 13, 1998**

[54] ENHANCED CONCERT AUDIO PROCESS UTILIZING A SYNCHRONIZED HEADGEAR SYSTEM

[75] Inventors: Randy Oltman, Highland Park, N.J.; Perry L. Nusbaum, Washington, D.C.; Ken Schaffer, New York, N.Y.; David Jakubowski, Washington, D.C.

[73] Assignee: The Headgear Company, NY, N.Y.

[ * ] Notice: The term of this patent shall not extend beyond the expiration date of Pat. No. 5,619,582.

[21] Appl. No.: 835,205

[22] Filed: Apr. 7, 1997

Related U.S. Application Data

[63] Continuation-in-part of Ser. No. 585,774, Jan. 16, 1996, Pat. No. 5,619,582.

[51] Int. Cl.[6] ..... H04R 27/00

[52] U.S. Cl. ..... 381/82; 381/79

[58] Field of Search ..... 381/77, 79, 80, 381/82, 83, 97, 183

[56] References Cited

U.S. PATENT DOCUMENTS 3,970,787 7/1976 Searle .
4,589,128 5/1986 Pfleiderer .
4,593,404 6/1986 Bolin .
5,425,106 6/1995 Katz et al. .
5,432,858 7/1995 Clair, Jr. et al. .

*Primary Examiner*—Vivian Chang
*Attorney, Agent, or Firm*—Longacre & White

[57] ABSTRACT

An audio enhancement system and method is provided wherein a wireless headphone system comprises a transmitter and a receiver. The transmitter for this system broadcasts a Direct Sequence Spread Spectrum (DSSS) CDMA signal on a number of separate code channels in the 902–928 MHz ISM band. Each successive code channel will have its audio signal delayed by a preset period, e.g. 30 mS, relative to the previous channel. A reference signal on one or more separate time synchronized code channels will be simultaneously transmitted from multiple dedicated transmitters within the venue. Analysis of these multiple code channels by the electronics in the headset will provide the headset with an approximate radial distance from the stage. The headset receiver, supporting position location signals, and associated hardware will select the appropriate audio code depending on the listener's distance from the main loudspeakers. These code channels are laid out such that when in a large venue, and if the proper channel is chosen, the sound received electronically over the wireless channel will be slightly behind the phase of the sound arriving to the listener from the main loudspeakers. The headgear associated with this system also enhances the quality of the music delivered to the transient listener.

22 Claims, 3 Drawing Sheets

ENHANCED CONCERT AUDIO PROCESS UTILIZING A SYNCHRONIZED HEADGEAR SYSTEM

This application is a Continuation-in-part of Ser. No. 08/585,774, filed Jan. 16, 1996, now U.S. Pat. No. 5,619,582.

BACKGROUND OF THE INVENTION a) Field of the Invention

The present invention generally relates to audio systems and more particularly to systems for enhancing the sound received by transient individuals located at discrete locations distanced from a primary loudspeaker system. The subject audio system permits transient individuals to roam within a predetermined area while enhancing from the sound quality delivered to these individuals.

b) Description of Related Art

The current state of the art for sound reproduction or sound supporting equipment used in concert halls or in other indoor and outdoor spaces entails the use of one or more loudspeaker cluster locations. These locations are typically located at or near the physical location of the actual sound source or that of the virtual sound source. Unfortunately, the acoustical sound reproduction quality of such conventional systems is detrimentally effected by distortion of the frequency and time spectrum resulting from the distances travelled by the sound. Also, non-linear type distortions are introduced due to the physics of the air compression and rarifactions by which the sound propagates. Moreover, since the perceived loudness and sound pressure level decreases in proportion to the distances travelled from the sound source, in order to achieve the desired sound pressure level at remote listener positions substantially more sound pressure must be developed at the source. However, increasing sound pressure level at these discrete locations produces increased distortion.

Persons attending concerts, shows, or speaking engagements in large halls or arenas (indoor as well as outdoor) are becoming more demanding in their desires for high quality sound; they want to have the sound quality delivered to their specific location by public address systems which mimic recording studio quality or at least mimics the sound quality at the main loudspeaker's mixer board. One common approach taken by sound system designers is to utilize "delayed speaker systems" in combination with the main loudspeaker system. In particular, additional loudspeakers are provided at remote locations in order to direct quality sound reproduction to individuals who are poorly positioned to receive sound from the main loudspeaker system. These fixed remote loudspeakers typically have their input signals delayed in time with respect to signals provided to the main loudspeaker systems to synchronize their acoustic output with the sound arriving from the main loudspeaker system; this approach reduces echo and feedback which results from two sound sources which are offset in distance. However, these fixed remote loudspeakers fail to properly serve transient individuals.

In an attempt to provide an enhanced audio system, U.S. Pat. No. 5,432,858 to Clair, Jr., et al. teaches a audio system comprising a wireless transmitter and plural augmented sound reproducing systems. Each sound subsystem is a portable unit arranged to be carried by a person located at a remote position with respect to the main loudspeaker. Each sound subsystem includes a receiver for receiving a broadcast signal, and a microphone positioned on a headset to detect sound arriving from the main loudspeakers. The sound subsystem further includes circuitry which augments this broadcast signal to thereby synchronize the broadcast signal with the sound arriving from the main loudspeakers. In order to augment the broadcast signal in accordance with the teaching of this patent, the subsystem uses a delay circuitry provided in the subsystem headphone set which delays the broadcast signal received by the receiver for a predetermined period of time which generally corresponds to the time it takes for the sound arriving from the main loudspeakers to propagate through the air to the remote location of the headset.

The sound augmentation system disclosed by U.S. Pat. No. 5,432,858 takes one of three forms: a "zone" system, a "manually synchronized" system, and a "self-synchronized" system. For the "zone" system, the audience is broken into discrete zones, which encompass a known distance from the main sound source. Each listener located within a given zone receives augmented sound from a particular receiver/transducer subsystem delayed a predetermined time. Accordingly, the augmented sound and the main sound arrive at the ears of each listener within that zone in substantial synchronism. More particularly, audience members within each zone personally tune their respective receiver to the appropriate channel for their zone, to thereby listen to the sound reproduced by the associated remote transducer in substantial synchronism with the main arriving sound. However, each person attending a concert where the "zone" system of this invention is in use must be given instructions on how and why to tune his/her receiver/amplifier unit to a particular channel setting based on that individual's location. It will be understood by anyone familiar with typical concert environments, however, that such a system will be overly complicated and impractical to distribute and use. Moreover, this system overly limits the portability of the audio system because the "zone" system requires the user to manually tune his/her receiver during movement about the arena.

The second "manually synchronized" system of U.S. Pat. No. 5,432,858 is even more limiting than the "zone" system described above. The "manually synchronized" system requires the listener to manually adjust his/her time delay circuitry. With this arrangement, the entire audience is covered by a single transmitter zone, wherein the audio signal is broadcast over a single frequency by a common, single wireless transmitter to all of the receiver/transducer subsystems located throughout the concert hall. It will again be understood by anyone familiar with typical concert environments, however, that such a "manually synchronized" system will be overly complicated and impractical to both distribute and use.

The third "self-synchronized" system of U.S. Pat. No. 5,432,858 accomplishes synchronization of the broadcast signal and the sound arriving from the main loudspeakers by providing a sampling microphone on the portable transducer unit. The circuitry of the portable transducer unit automatically adjusts the time delay in response to the sound picked up by the sampling microphone. This "self-synchronized" system suffers from the drawback in that it requires overly complex, costly and bulky circuitry. Specifically, the receiver/amplifier unit requires a wireless receiver, signal dynamics processor with a gating circuit, a programmable control signal delay circuit, a signal gate, a microphone preamplifier, a summing circuit, and a signal correlation circuit. The signal correlation circuit itself comprises a correlate circuit and a controller. Of course, the sampling microphone is inherently susceptible to background ambient noise, and thus require further means to disable the microphone when not in the presence of the main arriving sound.

While the foregoing approaches to achieve sound enhancement have some aural benefits, these conventional systems nevertheless suffer from numerous drawbacks resulting from decreased sound quality being delivered to remote listeners. These systems also limit the listener to specific listening areas, thus do not satisfy the listening needs of a mobile audience. Moreover, the prior art systems result in relatively complex, unwieldy and inflexible sound reproduction systems. Thus, the resulting size, weight and cost of these prior art receivers are preclusive.

Accordingly, the need exists for an audio enhancement system which overcomes the disadvantages of the prior art.

SUMMARY OF THE INVENTION

It is generally the object of this invention to provide an audio enhancement system which overcomes the disadvantages in the prior art.

It is further the object of this invention to provide an audio enhancement system for providing a synchronized signal to transient persons located at remote distances from a main loudspeaker so that the synchronized signal provides a studio quality sound, or at least a mixer-board quality sound, that is uniquely synchronized with the sound delivered by the main loudspeakers.

It is further the object of this invention to provide a new effect called the HeadGear Effect, a unique combination of the visceral components of the stage sound with the reinforced highs from an individual's wireless system.

In accordance with these and other objects of the instant invention, an audio enhancement system and method is provided wherein a wireless headphone system comprises a transmitter and a receiver which utilize an unlicensed frequency band defined by the FCC for in-home and short-range use.

The transmitter for this system broadcasts a Direct Sequence Spread Spectrum (DSSS) CDMA signal on a number of separate code channels in the 902–928 MHz ISM band. Each successive code channel will have its audio signal delayed by a preset period, e.g. 30 mS, relative to the previous channel. A reference signal on one or more separate time synchronized code channels will be simultaneously transmitted from multiple dedicated transmitters within the venue. Analysis of these multiple reference channels by the electronics in the headset will provide the headset with an approximate radial distance from the stage. The headset receiver, supporting position location signals, and associated hardware will select the appropriate code channel depending on the listener's distance from the main loudspeakers. These code channels are laid out such that when in a large venue, and if the proper channel is chosen, the sound received electronically over the wireless channel will be slightly behind the phase of the sound arriving to the listener from the main loudspeakers.

Listener location is determined and the appropriate transmission channel is automatically selected in a novel manner whereby dedicated reference code channel transmitters are strategically located in the venue. Each individual headset and associated receiver will calculate its approximate position based on the signals provided by these dedicated reference code channel transmitters, and will tune in to one of the channels broadcasting the CDMA signal in the prescribed MHz band.

The HeadGear Effect is realized by a unique acoustic phenomena in combination with special effects processing. The psycho-acoustic phenomena involved is derived from the "Haas Effect", which is well known in the acoustic art. The Haas effect states that a listener hearing two more copies of a particular sound will believe the sound to come from the direction of the first arriving sound regardless of relative amplitudes of the arriving sounds. Thus, since the HeadGear system provides sound reinforcement slightly after (5–10 mS) the arriving stage sound, a listener will perceive the sound to be coming from the direction of the stage regardless of his/her orientation or whether eyes are closed. This is a particularly important part of the HeadGear effect in order to keep the emphasis of the concert environment on the performers as opposed to a listener concentrating on the headset. The second part of the HeadGear Effect is the audio processing involved with providing the user's headset sound. Given that the HeadGear headset is designed to be acoustically transparent in order to allow conversations and to not encumber the user, most of the arriving stage sound is available to the listener; however, anything that covers even part of the ear will incur some sound loss to the individual. With the best acoustically transparent headsets, voices will be understood, but the very high tones of the music will be slightly impaired. This is acceptable, because in a larger venue, the reverberations off of everything in the environment (walls, people, etc.) primarily disturbs the high tones. The low visceral tones of the music remain relatively unaffected. Thus, the effects-processing portion of the present HeadGear system seeks to reinforce the high tones primarily. As can be appreciated by any one skilled in the art, the small transducers in a headset cannot compete with the low tones provided by a multi-kilowatt concert or other large venue speaker system. However, the high tones can be effectively delivered by these small transducers, thereby compensating for the poor high tone quality of such large venue systems. The combination of very clear high tones as provided by the HeadGear headset, along with the visceral low components of the sound provided by the house speakers in conjunction with the Haas effect describe, in part, what is to be known as the HeadGear effect.

Aside from the acoustically transparent nature of the headset, other special effects or enhancements may be made to the wireless signal that is delivered to the transient listener in order to improve the musical experience.

This system therefore provides a method and apparatus for accurately receiving a broadcast signal, enhancing the studio quality sound of this signal, and synchronizing this signal with the sound arriving from the main loudspeaker system. The system of the invention is simple to use, does not require manual operation by the user, and permits each individual to roam with respect to the main loudspeaker system without suffering from feedback, distortion, or adversely out-of-synch sound reproduction.

Other advantages and benefits of the instant invention will become apparent to those of skill in the art in view of the following drawings, and the detailed description that follows.

DETAILED DESCRIPTION OF THE PREFERRED EMBODIMENT

Figure 1:
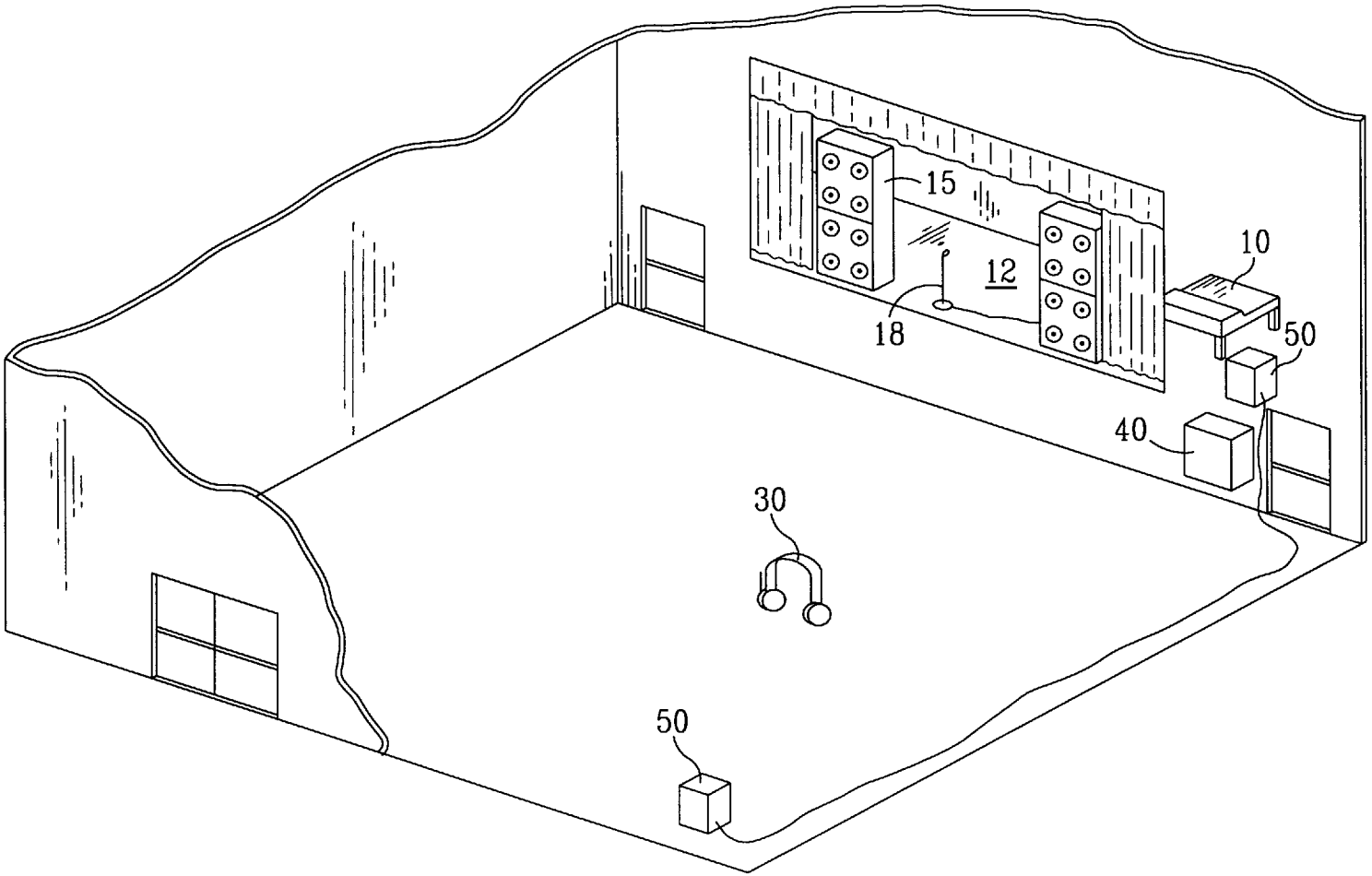
FIG. 1 is a schematic representation of the venue served by the audio system of this invention.
Figure 2:
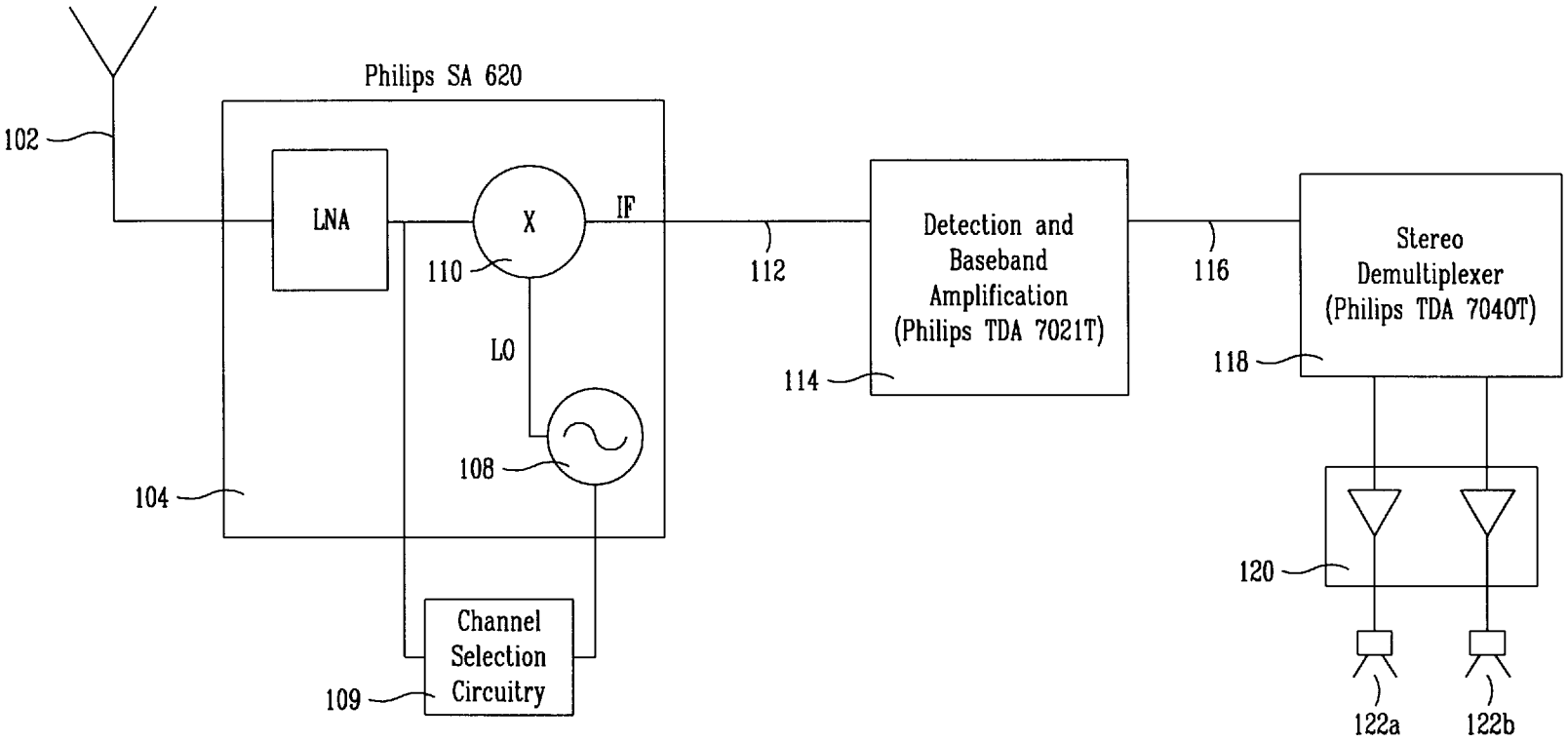
FIG. 2 is a schematic representation of the receiver and transducer unit of this invention.
Figure 3:
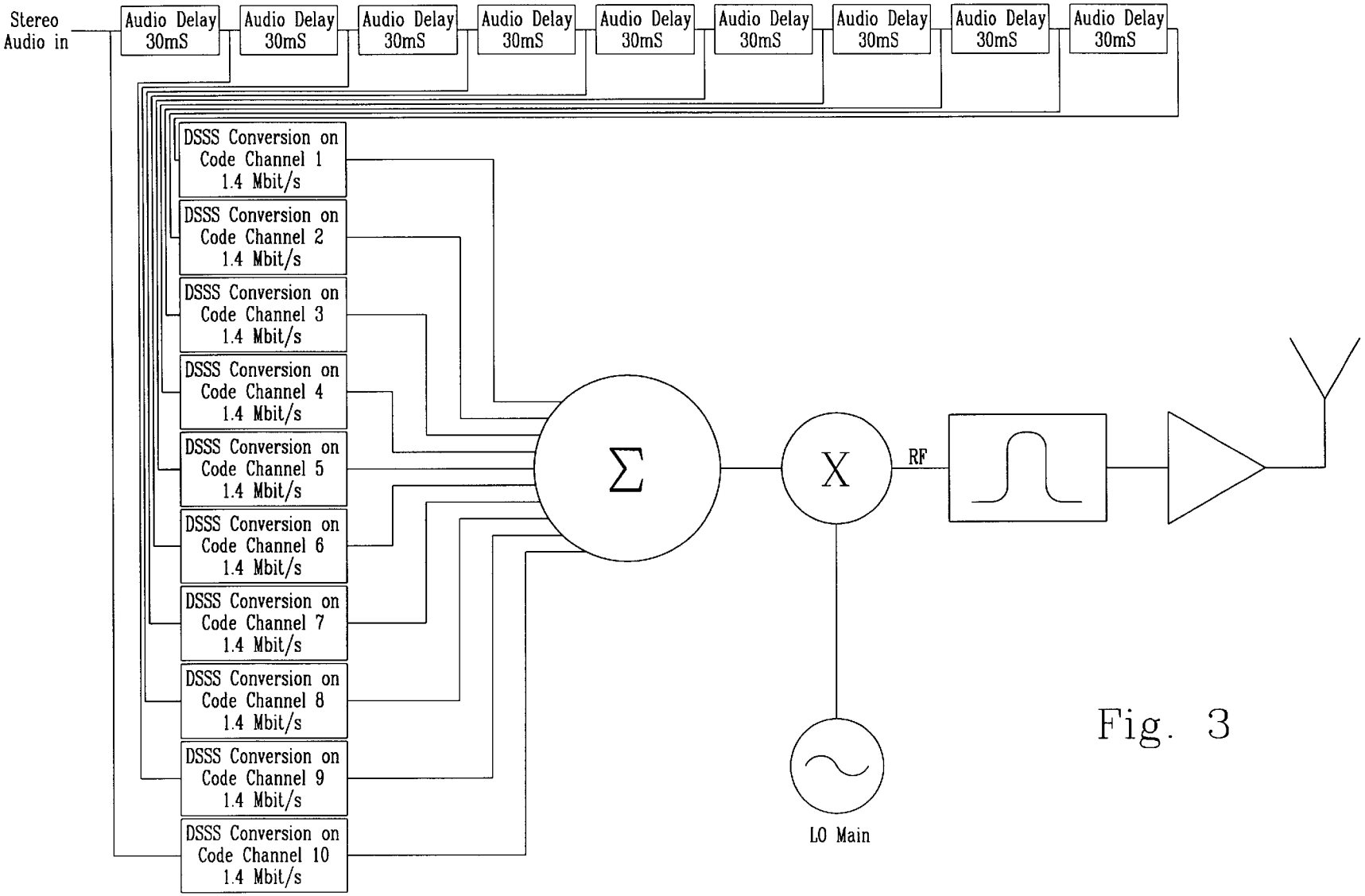
FIG. 3 illustrates an example of circuitry for channel splitting and transmission via the headgear transmitter(s).

Referring to FIGS. 1–3, an audio enhancement system for use with conventional sound reproduction systems will now be described with reference to several preferred embodiments. It will be understood that the embodiments described herein are not intended to limit the scope of the invention, but merely provide examples of the present invention as used in several environments.

The primary sound reproductive system can be any type of system having at least one primary loudspeaker or at least one main cluster of loudspeakers 15 located at one position, e.g. a stage or podium 12. The loudspeaker system produces sound in response to an electronic input signal provided by any suitable audio source, for example microphone 18, which is processed by a main sound board or mixer board 10. While the invention is primarily envisioned for use with live public broadcast or entertainment, it should be noted that the invention is equally suited for use in simulcast or recorded broadcast, or any arena (indoor and outdoor) wherein audio enhancement may be integrated with a primary loudspeaker system. The main loudspeaker(s) 15 propagate the sound produced thereby through the air so that it may be heard by persons located at various positions about the arena.

The audio enhancement system of this invention serves to augment or enhance the sound heard by transient individuals by providing distortion-free, enhanced sound via personal transducer devices which are located near or carried by such persons. To ensure that the distortion-free sound enhances rather than degrades the primary sound arriving from the main loudspeakers, the system of this invention is designed so that the audio enhancement system provides a signal utilizing the HeadGear effect, i.e., the combination of very clear high tones as provided by the headset of this invention, along with the visceral low components of the sound provided by the house speakers in conjunction with the Haas effect.

As will be appreciated by those possessing skill in the art, the implementation of audio enhancement in accordance with the teaching of this invention may take various configurations. However, these embodiments are merely exemplary. Thus, other configurations may be constructed in accordance with the teachings of this invention.

Each of the embodiments of the audio enhancement basically comprises at least one transmitting subsystem and at least one remote receiver subsystem. Those subsystems will be described in detail below. In general, each receiver subsystem basically comprises a receiver compactly housed within a portable unit, and an associated portable transducer unit, i.e., a pair of headphones.

Each receiver subsystem is arranged to be located at any remote location inhabited by the listener so that it may receive electrical signals transmitted from transmitter subsystem(s). The signals broadcast by the transmitter subsystem(s) represent(s) the signals provided by the audio source to the main loudspeaker(s), and preferably comprises a signal delivered from a central mixer board. The receiver unit of the subsystem receives the broadcast signals, then converts, processes and amplifies them into signals for driving the associated transducer device, i.e. headphones, to produce a sound substantially synchronized with the sound arriving from the main loudspeakers.

In order to facilitate locating a receiver subsystem as near as possible to the listener, the electrical signal provided to the receiver is transmitted without wire. Thus, the system makes use of wireless transmitters in the transmitting subsystem for broadcasting the audio signals to the plural and transient remote receiving and transducing subsystems.

As previously mentioned, the audio enhancement system of this invention basically comprises at least one transmitter subsystem and at least one remote receiving subsystem. In order to synchronize the sound arriving to the receiving subsystem with the sound arriving from the main loudspeaker(s), the present invention provides a synchronizing means. The synchronizing means includes multiple dedicated electromagnetic transmitters which locate the receiving subsystem and tune the receiver subsystem to a suitable delay channel which is received by the receiving subsystem. Alternately, the location information could be used to control a variable delay line within the receiver unit in order to provide the necessary audio time compensation laid out by the overall scope of this patent. In any event, the signal delivered through this delayed channel by either of the above methods will have a proportioned time delay that compensates for the time period it takes for the primary sound delivered by the loudspeakers to propagate through the air to the remote location of the receiver subsystem.

The receiver subsystem of this invention is designed to detect electromagnetic information to approximate a radial distance from the main sound source.

For these synchronization means, the receiver uses the position location information to pick one of a plurality of channels that will be broadcast at approximately 900 MHz by the transmitter subsystem. The plurality of channels are chosen such that each successive channel is delayed by a fixed amount relative to each other. For the position location and channel determination of this invention, an X,Y position is not necessary; rather, an approximate radial distance from the front of the main loudspeaker system is preferred. It should be noted that the human ear can only perceive the difference in arrival time of two sounds (in the same ear) when the sounds are more than about 25 ms apart. In view of these facts, the radial position of the receiver need only be accurate within 15–30 feet. An alternate method of accomplishing the necessary audio delay is to use the position location information to control an audio delay line. The electronics in the receiving subsystem using the knowledge of the position location system would add an incremental amount of delay proportional to the receiver's radial distance from the primary sound source.

Many different methods of position location are possible, including the following preferred method: multiple dedicated reference transmitters are positioned in a single venue, one in the front and one or more in various unique positions within the venue. The front reference transmitter outputs a dedicated reference signal. The surrounding reference transmitters also send out their own reference signals. Headsets in different locations in the venue receive the reference signals with a varying amount of time delay on the reference signal based on their position within the venue, and also based on the speed of travel of electromagnetic waves. This difference in arrival time of the reference signal(s) is perceivable electronically, and could be used to find and approximate location of an individual headset.

One must consider that the system of this invention is not attempting to match electromagnetic waves, but instead matches the phase of sound pressures from the stage and through the headset. When dealing with sound pressures, the ear is much more tolerant of error than an electronic receiver is to phase errors in electromagnetic waves. Thus errors in the phase match of the two combining sounds will not easily be perceived by the user. In fact, laboratory simulations shows that if the delay difference of these two sound signals are matched to within 25 ms, then there is no perceived difference between the two waveforms by a listener.

The receiver may operates as follows. With reference to FIG. 2, the signal is received by the antenna 102 and goes directly to a multipurpose integrated circuit 104, e.g., the Philips SA620 multipurpose IC. Such an integrated circuit contains a low noise amplifier (LNA) 106, a down converter (double balanced mixer) 108, and a voltage controlled oscillator (VCO or local oscillator, LO) 110. The low noise amplifier 106 first amplifies the radio signal delivered by the antenna 102. The signal is then down-converted by the mixer 110 using a frequency provided by the local oscillator 108. The IF 112 output of the multipurpose IC will be a signal containing multiple signal channels on different codes, and also contains the necessary reference signals for distance location. The receiver will look for and compare the reference signals. Based on the information from analysis of the reference signals(s), an appropriate code channel will be chosen to be demodulated. Using a known pseudo-random code for the particular channel chosen, the channel will then be demodulated using DSSS methods.

With reference to FIG. 1, the audio enhancement system of this invention will now be described. Sound is first picked up by microphones 18 for the instrument or voice. This sound is directed to the central sound board 10 where all the individual sounds are processed and mixed together. Effects and equalization happens at this point. Next the sound is sent to power amplifiers, and from there to the speaker system 15. The mixed, equalized sound is also sent to the transmitter subsystem, i.e. headgear 40, (at audio frequencies, electronically over signal cables).

In the headgear transmitter(s) 40, the arriving audio signal is split into 10 channels, and each channel is then delayed by a pre-established amount of time. Each of these delayed copies of the original signal is then modulated using Direct Sequence Spread Spectrum methods on to its own code channel. FIG. 3 illustrates an example of circuitry for channel splitting and transmission via the headgear transmitter(s) 40.

Separate to the Headgear transmitter(s) is one or more HeadGear reference location transmitter(s). The timing of the transmitter system is chosen such that a receiver in the venue can receive and determine an approximate radial position based on the difference in arrival time of the prescribed reference signals. Based on the arrival time of the reference signals the channel selection algorithm in the baseband processing unit will either pick an appropriately delayed code channel, or set the delay on an audio delay line within the receiver subsystem. With this arrangement, the chosen channel will have its audio portion delayed approximately by the same amount of time as it takes for the sound to travel from the stage speakers to the position of the receiver. Thus, the electronic sound and the sound travelling through the air will be approximately in phase, and the listener will not perceive any echoes or mismatch between the timing between the two sounds other than the desired Haas effect element of the present invention.

The system of the present invention is unobtrusive and works in conjunction with the existing PA sound to produce a revolutionary sound experience. Existing PA sound provides the visceral, "boom-boom" which is expected from the live environment. However, the delicate intricacies or "highs" of the music are muddled and/or lost as the existing PA sound travels. The HeadGear supplemental signal set forth in this invention will deliver these intricacies transparently over top of the existing visceral sound of the PA system. Further, by delaying the supplemental signal slightly behind the arrival of the existing PA sound, the HeadGear System utilizes the Haas Effect, which says that the ear will derive direction based upon the first arriving signal regardless of strength or proximity. Consequently, the ear will pre-determine the origin of the sound as the stage (just as was intended by the performer) even though a supplemental signal containing the intricacies of the music will originate at the ear. In addition, the present system utilizes "acoustically transparent" headphones so as not to inhibit the existing, visceral PA sound. Acoustically transparent refers to the physical design ofthe headphone. The headphones for the system will not encompass the ear, instead the will slide into the ear so that surrounding sound and ambient noise will blend with the supplemental signal. In essence, the HeadGear system transparently blends the visceral "boom-boom" of the PA with the digital, supplemental signal (containing the nuances of the music) while maintaining an unobtrusive position on the person so that it is not necessary to increase volume nor is there any sense of isolation. The attendee will not realize that any supplemental signal is laid over top of the existing sound. The two signals work in conjunction and are indistinguishable. In fact the attendee's have a tendency to forget they have the headset on until they take it off and hear the muffled, comparatively awful sound of the PA system. We, as a society, have become accustomed to this type of high quality audio in the home, the HeadGear System simply extends this to the live environment.

While the description of this invention has focused on the use of ten channels, it will be understood by those having skill in the art that the number of channels may be chosen depending on the size of the particular venue to be serviced and the range of accuracy sought. Using ten channels each successively delayed by 30 mS offers a maximum delay of 300 mS. This corresponds to an approximate matched distance of 100 meters, a range of coverage deemed adequate for most venues.

While the instant invention has been shown and described with reference a number of preferred embodiments, it will be understood by those possessing skill in the art that various changes in form and detail may be made without departing from the spirit and scope of the present invention.

We claim:

1. An audio enhancing system for delivering an enhanced audio signal from a primary source to a plurality of discrete locations located within an arena, said audio enhancing system comprising:

an audio source means for generating a first audio signal and for converting said first audio signal to a first electromagnetic signal;

a primary signal propagating means for broadcasting said first audio signal;

a first transmitting means for transmitting said first electromagnetic signal via a wireless media;

a second transmitting means for transmitting an electromagnetic locating signal, said electromagnetic locating signal comprising information related to a relative position of said receiver means with respect to said primary signal propagating means;

a receiver means for receiving said first electromagnetic signal and said electromagnetic locating signal, said receiver means converting said first electromagnetic signal into a second audio signal and determining said relative position of said receiver based on said electromagnetic locating signal.

2. The audio enhancing system according to claim 1, wherein said first transmitting means divides said first electromagnetic signal into a plurality of channels which are time-delayed with respect to one another prior to being transmitted by said first transmitting means.

3. The audio enhancing system according to claim 2, wherein said receiver means selects one channel of said plurality of channels based on said relative position of said receiver means.

4. The audio enhancing system according to claim 1, wherein said receiver means automatically delays said first electromagnetic signal based on said relative position of said receiver means.

5. The audio enhancing system according to claim 1, wherein said receiver means intentionally broadcasts said second audio signal a predetermined time period later than said first audio signal is delivered to said receiver means.

6. The audio enhancing system according to claim 5, wherein said predetermined time period is about 5–10 mS.

7. The audio enhancing system according to claim 2, wherein said second transmitting means comprises at least one dedicated electromagnetic transmitter transmitting said electromagnetic locating signal.

8. The audio enhancing system according to claim 1, further comprising a synchronization means for synchronizing said second audio signal generated by said receiving means with said first audio signal based on said relative position.

9. The audio enhancing system according to claim 8, wherein said second audio signal is transmitted by said receiver a predetermined time period after said first audio signal arrives at said receiving means.

10. The audio enhancing system according to claim 9, wherein said predetermined time period is about 5–10 mS.

11. The audio enhancing system according to claim 8, wherein said first transmitting means divides said first electromagnetic signal into a plurality of channels which are time-delayed with respect to one another prior to being transmitted by said first transmitting means, and wherein said synchronization means tunes said receiving means to one of said channels based on said relative position.

12. The audio enhancing system according to claim 1, wherein said second transmitting means comprises a plurality of dedicated transmitters transmitting said electromagnetic locating signal in the form of reference signals at regular intervals, wherein a radial distance of said receiver means from said transmitting means is calculated based on said reference signals.

13. The audio enhancing system according to claim 1, wherein both said receiver means and said synchronization means are positioned on a portable headset worn by a transient listener.

14. The audio enhancing system according to claim 13, wherein said portable headset is substantially acoustically transparent to thereby increase an amount of said first audio signal that is received by said transient listener.

15. An audio enhancing system for delivering an enhanced audio signal from a primary source to a plurality of discrete locations located within an arena, said audio enhancing system comprising:

an audio source means for generating a first audio signal and for converting said first audio signal to a first electromagnetic signal;

a primary signal propagating means for broadcasting said first audio signal;

a first transmitting means for transmitting said first electromagnetic signal via a wireless media;

a second transmitting means for transmitting an electromagnetic locating signal;

a receiver means for receiving said first electromagnetic signal and said electromagnetic locating signal, said receiver means converting said first electromagnetic signal into a second audio signal and determining a relative position of said receiver with respect to said primary signal propagating means based on said electromagnetic locating signal, wherein said receiver means intentionally broadcasts said second audio signal a predetermined time period later than said first audio signal arrives at said receiver means.

16. The audio enhancing system according to claim 15, wherein said predetermined time period is about 5–10 mS.

17. The audio enhancing system according to claim 15, wherein said receiver means is worn by a transient listener and is substantially acoustically transparent to thereby increase an amount of said first audio signal that is received by said transient listener.

18. The audio enhancing system according to claim 17, wherein said second audio signal compensate for a portion of said first audio signal that is not adequately heard by said transient listener.

19. The audio enhancing system according to claim 15, wherein said first transmitting means divides said first electromagnetic signal into a plurality of channels which are time-delayed with respect to one another prior to being transmitted by said first transmitting means.

20. The audio enhancing system according to claim 15, wherein said receiver means selects one channel of said plurality of channels based on said position of said receiver means.

21. The audio enhancing system according to claim 15, wherein said receiver means automatically delays said first electromagnetic signal based on said position of said receiver means.

22. The audio enhancing system according to claim 15, wherein said second transmitting means comprises at least one dedicated electromagnetic transmitter transmitting said electromagnetic locating signal.

* * * * *